US011203824B2

(12) United States Patent
Stingel

(10) Patent No.: US 11,203,824 B2
(45) Date of Patent: Dec. 21, 2021

(54) MACHINE KNITTING TOOL, IN PARTICULAR MACHINE KNITTING NEEDLE

(71) Applicant: Groz-Beckert KG, Albstadt (DE)

(72) Inventor: Uwe Stingel, Meßstetten (DE)

(73) Assignee: Groz-Beckert KG, Albstadt (DE)

( * ) Notice: Subject to any disclaimer, the term of this patent is extended or adjusted under 35 U.S.C. 154(b) by 52 days.

(21) Appl. No.: 16/624,018

(22) PCT Filed: Jun. 15, 2018

(86) PCT No.: PCT/EP2018/065967
§ 371 (c)(1),
(2) Date: Dec. 18, 2019

(87) PCT Pub. No.: WO2018/234183
PCT Pub. Date: Dec. 27, 2018

(65) Prior Publication Data

US 2020/0173070 A1 Jun. 4, 2020

(30) Foreign Application Priority Data

Jun. 19, 2017 (EP) ..... 17176608

(51) Int. Cl.
*D04B 35/04* (2006.01)
*D04B 35/06* (2006.01)
*D04B 9/02* (2006.01)

(52) U.S. Cl.
CPC ..... *D04B 35/04* (2013.01); *D04B 35/06* (2013.01); *D04B 9/02* (2013.01)

(58) Field of Classification Search
CPC ..... D04B 35/04; D04B 35/06; D04B 35/08; D04B 9/02; D04B 15/06
(Continued)

(56) References Cited

U.S. PATENT DOCUMENTS 4,036,036 A 7/1977 Ashmead et al.
4,089,192 A * 5/1978 Kohorn ..... D04B 35/04 66/123
(Continued)

FOREIGN PATENT DOCUMENTS

CN 2178245 Y 9/1994
CN 101072909 A 11/2007
(Continued)

OTHER PUBLICATIONS

European Search Report dated Dec. 15, 2017, in corresponding European Application No. 17176608.2 (8 pages).
(Continued)

*Primary Examiner* — Khoa D Huynh
*Assistant Examiner* — Grace Huang
(74) *Attorney, Agent, or Firm* — Fitch, Even, Tabin & Flannery LLP

(57) ABSTRACT

A machine knitting tool and in particular a machine knitting needle has a shank extending in the longitudinal direction. The machine knitting tool has a stitch-forming portion directly adjacently to a front end and a drive portion directly adjacently to a rear end. At least in the drive portion, an underside of the shank does not have any indentations or recesses and extends along a plane. The shank in the drive portion forms at least one rib portion with a rib height, which is at most 1.1 mm. In addition, the shank in the drive portion forms at least one support elevation, which extends in the height direction beyond the rib height of the at least one rib portion and has an elevation height at its point of maximum height.

12 Claims, 3 Drawing Sheets

(58) Field of Classification Search
USPC ..... 66/123, 124, 116
See application file for complete search history.

(56) References Cited

U.S. PATENT DOCUMENTS

| | | | | | |
|---|---|---|---|---|---|
| 4,452,053 | A * | 6/1984 | Egbers | D04B 35/04 | 66/123 |
| 4,532,781 | A * | 8/1985 | Buck | D04B 15/06 | 66/104 |
| 4,553,411 | A | 11/1985 | Schuler et al. | | |
| 4,608,841 | A * | 9/1986 | Buck | D04B 15/06 | 66/104 |
| 5,010,744 | A * | 4/1991 | Kawase | D04B 15/06 | 66/93 |
| 5,154,069 | A | 10/1992 | Speetjens et al. | | |
| 5,231,855 | A | 8/1993 | Seta et al. | | |
| 6,105,402 | A * | 8/2000 | Lee | D04B 9/12 | 66/217 |
| 6,269,665 | B1 * | 8/2001 | Wang | D04B 9/12 | 66/107 |
| 6,341,570 | B2 * | 1/2002 | Fujiwara | D04B 9/40 | 112/475.12 |
| 6,510,713 | B1 * | 1/2003 | Shima | D04B 35/06 | 66/120 |
| 7,533,546 | B2 * | 5/2009 | Stingel | D04B 15/68 | 66/104 |
| 7,690,223 | B2 * | 4/2010 | Abe | D04B 35/04 | 66/123 |
| 7,836,729 | B2 * | 11/2010 | Kirchmair | D04B 35/04 | 66/123 |
| 7,874,181 | B1 * | 1/2011 | Lindahl | D04B 3/02 | 66/117 |
| 7,874,183 | B2 * | 1/2011 | Fehrenbacher | D04B 35/04 | 66/123 |
| 8,468,854 | B2 * | 6/2013 | Yang | D04B 15/06 | 66/93 |

FOREIGN PATENT DOCUMENTS

| | | | | |
|---|---|---|---|---|
| CN | 101532208 | A | 9/2009 | |
| DE | 2245731 | A1 * | 3/1974 | D04B 35/06 |
| DE | 2820925 | A1 | 11/1979 | |
| DE | 3014751 | A1 | 10/1981 | |
| DE | 69218303 | T2 | 10/1997 | |
| EP | 0520704 | A1 | 12/1992 | |
| GB | 1577481 | A * | 10/1980 | D04B 15/06 |

OTHER PUBLICATIONS

International Search Report and Written Opinion dated Sep. 14, 2018, in corresponding International Application No. PCT/EP2018/065967, with machine English translation (13 pages).

Chinese Office Action dated Jun. 10, 2021, in corresponding Chinese Application No. 201880040672.1, with English translation (18 pages).

Chinese Third Office Action dated Oct. 28, 2021, in corresponding Chinese Application No. 201880040672.1, with machine English translation (14 pages).

* cited by examiner

MACHINE KNITTING TOOL, IN PARTICULAR MACHINE KNITTING NEEDLE

CROSS REFERENCE TO RELATED APPLICATIONS

This patent application is the national phase of PCT/EP2018/065967, filed Jun. 15, 2018, which claims the benefit of European Patent Application No. 17176608.2, filed Jun. 19, 2017.

FIELD

The invention relates to a machine knitting tool and in particular a machine knitting needle. The machine knitting tool is preferably designed to be used in the knitting of staple fibre yarns, such as cotton yarns. The machine knitting tool or the machine knitting needle is preferably a latch needle or a compound needle.

BACKGROUND

A multitude of machine knitting tools and machine knitting needles are known. Machine knitting needles, for example in particular latch needles, are moved in a guide channel or needle channel in a longitudinal direction during the knitting with a knitting machine. To this end, each machine knitting needle has a drive portion with a butt part. The butt part cooperates with a cam of the knitting machine in order to position or move the machine knitting needle in a needle channel in the longitudinal direction. In the case of circular knitting machines, the knitting cylinder is rotated with the machine knitting needles relative to the cam in a peripheral direction, and the butt parts of the machine knitting needles are guided in a cam track. Here, not only does a force act on the butt parts in the longitudinal direction of the machine knitting needles, but also transversely thereto in a transverse direction. Other machine knitting tools, such as hooks or sliders of compound needles, are also moved or positioned by means of a suitable drive device during knitting in a knitting machine.

Machine knitting tools of this kind have to satisfy a multitude of conditions, which are sometimes also conflicting. In order to achieve the greatest possible productivity, high movement speeds are required, for example a high rotary speed of a knitting cylinder of a circular knitting machine, which leads to correspondingly high accelerations and speeds of the machine knitting needles and other machine knitting tools of the knitting machine.

In order to enable high accelerations, a low mass of the machine knitting tool is advantageous on the one hand. On the other hand, machine knitting tools must have a long service life, and there must be no excessive signs of wear or damage as a result of the introduction of the acceleration forces. The replacement of a defective machine knitting tool requires the knitting machine to be stopped and leads to a loss of productivity. The machine knitting tool must be able to be positioned in a precise manner so as not to produce any errors at the time of stitch formation. The accuracy of the guidance or positioning of the machine knitting tool during the stitch-forming process also must not be impaired by remaining yarns, remaining fibres or other contaminants.

In order to take account of these various constraints, a wide range of embodiments of machine knitting tools have already been proposed. In order to avoid the risk of needle breaks, machine knitting needles are also known in which the shank comprises portions extending in a meandering manner, as is known for example from U.S. Pat. No. 5,231,855 or DE 69 218 303 T2. The object of this is to better damp the influence of jerky accelerations on the machine knitting needles and to avoid the risk of damage. The needles described there form a group, wherein the needles within a group each have a butt part, which sits at a different butt position compared with the butt parts of the other machine knitting needles within the same group. Where one of the needles has a butt part, the other needles each have a shank bridge.

A machine knitting needle having a meandering shank portion is additionally described in DE 28 20 925 A1. There, a rib portion arranged at a distance from the under-side has a rib height of at most 1.1 mm or 0.9 mm.

U.S. Pat. No. 4,036,036 A proposes, instead of meandering portions of a machine knitting needle, to provide apertures between the two side faces of the shank, which apertures can have different shapes and designs. Indentations or recesses on the underside and the upper side of the needle compared to the meandering shank portions are thus avoided.

DE 3 014 751 A1 describes for example a stamped machine knitting tool in the form of a latch needle. The shank has a plurality of apertures, which fully pass through the shank in the transverse direction and which open out on each side face of the shank. Annularly closed chambers are thus formed. These are delimited by two ribs extending parallel to one another in the longitudinal direction. Jerky accelerations should thus be better absorbed, and needle breaks should be avoided.

From CN 2 178 245 Y a machine knitting needle with the features of the preamble of claim 1 is known.

Proceeding from the prior art, one object of the present invention is to create a knitting tool that sufficiently complies with the constraints described in the introduction and permits high acceleration with precise guidance.

SUMMARY

This object is achieved by a machine knitting tool as disclosed herein.

In accordance with the invention a machine knitting tool and in particular a machine knitting needle having a shank extending in the longitudinal direction is proposed. The shank of the machine knitting tool has an underside, an upper side opposite the underside, and two side faces connecting the underside and the upper side. The side faces are arranged at a distance in a transverse direction at right angles to the longitudinal direction. The two side faces are preferably oriented parallel to one another.

The shank or the machine knitting tool has a front end and an opposite rear end. A stitch-forming portion directly adjoins the front end. In the embodiment of the machine knitting tool as a machine knitting needle, a needle hook is provided in the stitch-forming portion. When the machine knitting needle is embodied as a latch needle, a movably mounted latch can be provided in the stitch-forming portion, which latch can be moved between an open position and a closed position.

A drive portion of the machine knitting tool directly adjoins the rear end. In the drive portion, the ma chine knitting tool has at least one butt part. The butt part extends in a height direction at right angles to the longitudinal direction and at right angles to the transverse direction and has a butt part height starting from the underside. The butt part is designed to cooperate with a cam of the knitting machine during the stitch-forming process. The machine knitting tool can be moved and/or positioned by means of the butt part.

When reference is made in the description to a height of the shank or of certain parts of the shank, any height specifications are always given relative to the underside.

The underside of the machine knitting tool extends at least outside the stitch-forming portion in a single plane, which is spanned by the longitudinal direction and the transverse direction. The underside, relative to this plane, is free from elevations or indentations or apertures.

The side faces are preferably formed without recesses or indentations, at least in the drive portion. Thus, it is impossible for dirt to accumulate either in an indentation or recess on the underside, or in an indentation or recess on the side faces. The accumulation of dirt can lead to adverse effects with regard to the positioning accuracy of the machine knitting needles. If too much dirt accumulates in a recess, the friction during a movement of the machine knitting tool can also increase and cause intensified wear. The machine knitting tool is in particular designed to be used for the knitting of a staple yarn or a cotton yarn. In the case of yarns of this kind, a particularly high level of contamination is created in the knitting machine by remaining staple fibre yarns. The machine knitting tool is therefore particularly insensitive to contaminations of this kind.

In the drive portion the shank forms at least one rib portion, which has a rib height of at most 1.1 mm starting from the underside. Since the underside in the drive portion extends in the common plane, the rib portion, when guided in a guide channel of the knitting machine, bears against a corresponding face at the base of the guide channel. The rib portion is formed with a short height. The needle weight is thus reduced and the elasticity of the needle shank is increased. In the event of jerky accelerations, the loading on the butt part, at which the acceleration is introduced, is reduced and the risk of a break of the butt part is lowered. Since the rib portion extends without any distance from the underside and can therefore bear with its entire underside on a face of the knitting machine, any introduced oscillations are sufficiently damped. Rib or shank portions at a distance from the underside are not provided.

The short height (at least in portions) of the shank in the drive portion, in particular in the at least one rib portion, also reduces the torsional rigidity about a longitudinal axis extending parallel to the longitudinal direction. When the machine knitting tool is moved in a circular knitting machine in its transverse direction relative to a cam, forces directed in the transverse direction are introduced onto the butt part, which can lead to an inclination or to a tilting of the butt part about this longitudinal axis. So as to be able to counteract this and support machine knitting tools, at least one support elevation is provided in the drive portion, which support elevation extends in the height direction and has an elevation height. The elevation height is greater than the rib height and smaller than the butt part height. The support elevation is arranged at a distance from the butt part in the longitudinal direction. In the region of the support elevations, the shank has a relatively great height and is supported in the knitting machine with its underside on a guide face, which improves the supporting effect.

A channel wall of a guide channel of the knitting machine is provided between directly adjacent machine knitting tools. The machine knitting tools are supported on the channel wall by means of the support elevation. The local loads on the butt part are reduced and damage is avoided and/or the service life of the machine knitting tools is increased. Not only at the machine knitting tools, but also and especially at the channel wall of the knitting machine (knitting cylinder, needle bed), damage can be caused in the event of a break or deterioration of the machine knitting tool, which damage can only be remedied at great effort and cost.

The machine knitting tool according to the invention or the machine knitting needle according to the invention has a design that enables high knitting speeds and is insensitive to contamination. The design features are coordinated with one another and in the claimed combination lead to a particularly suitable construction of the machine knitting tool. The closed underside and/or the preferably closed side faces do not offer any opportunity for relatively great accumulations of remaining yarns or other dirt particles. The at least one rib portion makes the machine knitting tool insensitive to jerky accelerations introduced at the butt part. The rib portion is supported by the underside on a guide face in the knitting machine, for example on the base of a needle channel, so that any oscillations caused there are effectively damped and a high guidance accuracy is achieved. Adjacent machine knitting tools can be supported on a channel wall of the knitting machine by means of the support elevation, so that an inclination or a torsion of a machine knitting tool about an axis parallel to the longitudinal direction can be limited.

It is advantageous if at least one pair of (in each case) two support elevations is arranged in the drive portion. A concave indentation or a furrow in the upper side of the shank can be provided between the support elevations. The two support elevations of the same pair can be arranged at a support distance from one another in the longitudinal direction. This support distance is in particular the smallest distance in the longitudinal direction between the maximum of the two support elevations. For example, the support distance can correspond to a length dimension of the butt part in the longitudinal direction or can be slightly greater than the length dimension of the butt part.

Each support elevation for example can have two flanks running at an incline relative to the height direction and the longitudinal direction. A cleaning effect can thus be attained: Dirt is conveyed out from the guide channel of the knitting machine by the inclines of the flanks. Contaminations are thus conveyed out from the guide channel, and the infiltration of dirt particles or other contaminants under the needle shank is reduced or avoided.

The rear end of the machine knitting tool can be arranged at an end part of the shank. As considered in the transverse direction, the end part for example has a rectangular contour. The end part can have an end part length in the longitudinal direction. The end part length can correspond at least to the support distance between two support elevations of a pair.

It is preferred if the rib portion or one of the provided rib portions is arranged between the at least one support elevation and the butt part.

It is additionally advantageous if the shank in the drive portion forms a plurality of rib portions each having the same rib height. The bending load of an individual rib portion can thus be reduced.

In another advantageous exemplary embodiment, the butt part is arranged between two support parts. The support parts each extend with a support part height in the height direction H, which is at least as great as the elevation height. The two support parts can have the same or different support part heights. The support parts can be used to support the machine knitting tool at the channel wall of a guide channel of the knitting machine, directly adjacently to the butt part.

The machine knitting tools can form a group. All machine knitting tools within a common group differ from one another in respect of the butt position of their respective butt parts. The butt position of the butt part specifies the distance of the butt part from the front end and/or the rear end. Each machine knitting tool within a common group has the at least one support elevation at the point lying in the region of the butt position of another machine knitting tool within this group.

BRIEF DESCRIPTION OF THE DRAWINGS

Advantageous embodiments of the invention will become clear from the dependent claims, the description, and the drawings. Preferred exemplary embodiments will be explained in detail hereinafter on the basis of the accompanying drawings, in which:

DETAILED DESCRIPTION

Figure 1:
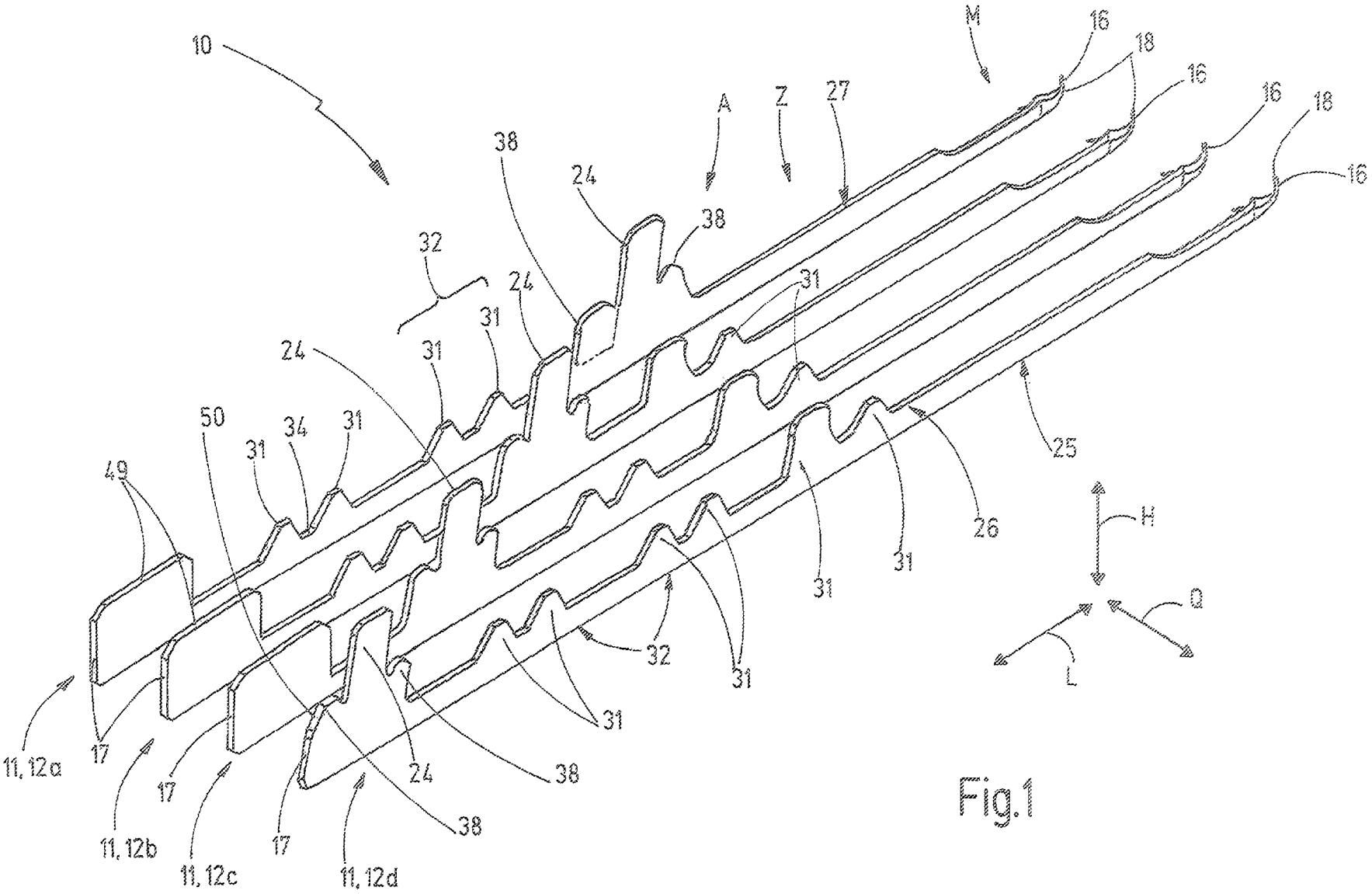
FIG. 1 shows a group of machine knitting tools embodied as machine knitting needles in a perspective view.
Figure 7:
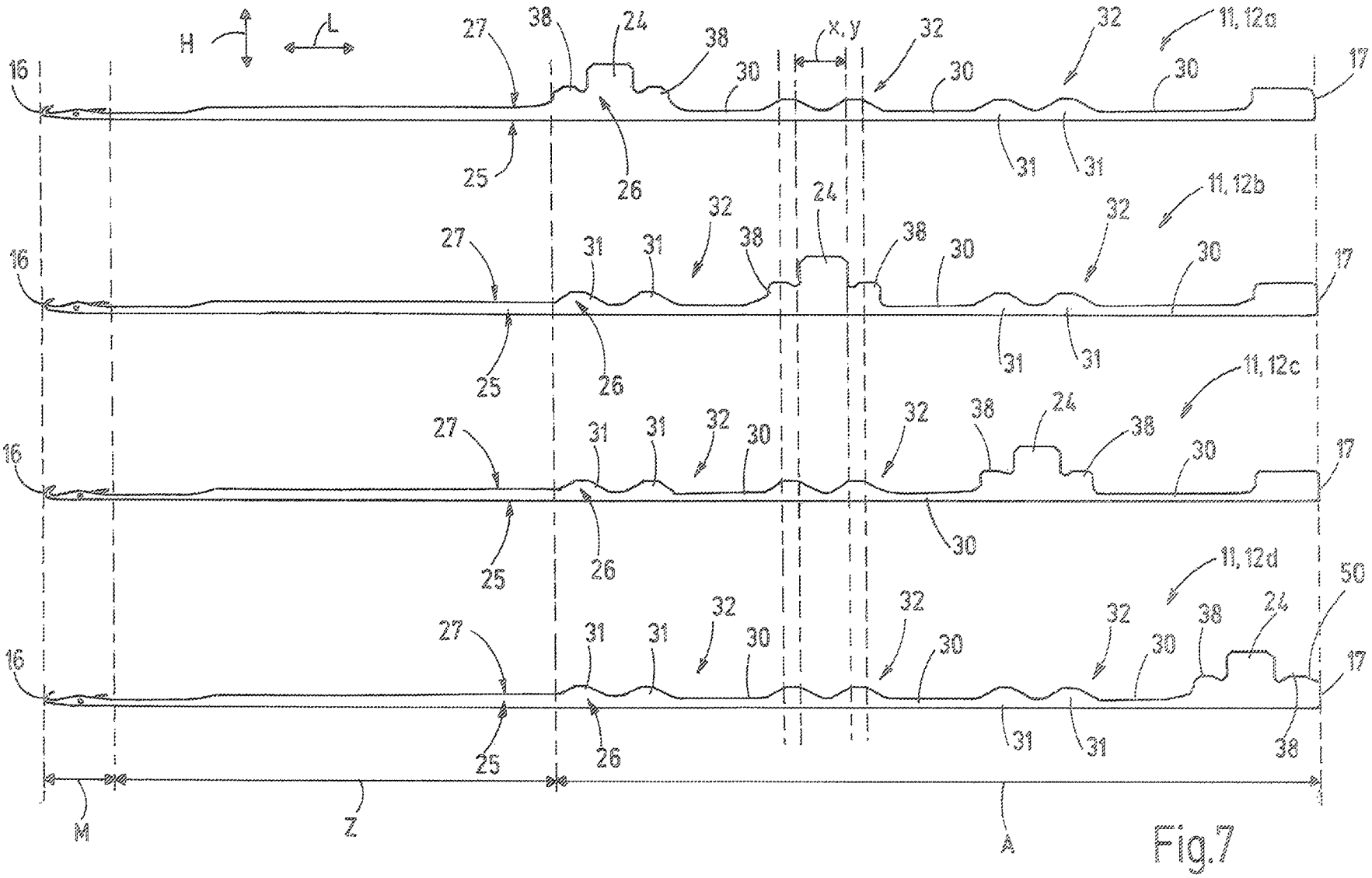
FIG. 7 shows the group of machine knitting needles from FIG. 1 in a side view, except that needles 12*b*, 12*c*, and 12*d* are shown with an alternative configuration of the front-most pair of support elevations 31 in which one of the support elevations 31 of the pair 32 is formed identically to other support elevation 31.

A group 10 of a plurality of machine knitting tools 11 and for example a plurality of machine knitting needles 12, specifically a first machine knitting needle 12*a*, a second machine knitting needle 12*b*, a third machine knitting needle 12*c*, and a fourth machine knitting needle 12*d*, is shown in FIGS. 1 and 7. The number of machine knitting tools 11 per group 10 can vary. Each group 10 can comprise two or more machine knitting tools 11.

The machine knitting tools 11 or machine knitting needles 12 within the same group 10 are formed differently. The differences will be described in greater detail further below.

The structure of a machine knitting needle 12 will be explained with reference to FIGS. 2-6 on the basis of the first machine knitting needle 12*a*.

The machine knitting needle 12 has a shank 15, which extends in a longitudinal direction L between a front end 16 and a rear end 17, which is opposite the front end 16. The machine knitting needle 12 is embodied as a latch needle in accordance with the example. At the front end 16, the shank 15 forms a needle hook 18. The needle hook 18 delimits a hook interior 19, which in the exemplary embodiment can be opened and closed by a latch 20. The latch 20 is for this purpose mounted in a bearing gap of the shank 15 so as to be pivotable about a pivot axis S. The pivot axis S extends in a transverse direction Q at right angles to the longitudinal direction L. The latch 20 can be pivoted about the pivot axis S between a closed position I, shown in a dashed manner in FIG. 3, and an open position II. In the closed position I, the latch 20 bears against the needle hook 18 and closes the hook interior 19. In the open position II, the latch 20 is distanced from the needle hook 18 and releases the hook interior 19, so that a stitch can be received in the hook interior 19 or can be removed from the hook interior 19. During the knitting process, the latch 20 is moved between the closed position I and the open position II with the aid of a stitch or a yarn portion.

In accordance with the example the region of the machine knitting needle 12 at which the needle hook 18 and the latch 20 are arranged forms a stitch-forming portion M. The stitch-forming portion M directly adjoins the front end 16. It ends preferably at the point at which a bearing gap for receiving the latch 20 ends. Alternatively, the end of the stitch-forming portion M opposite the front end 16 can be formed by the position assumed by the free end of the latch 20 in the open position II distanced maximally from the needle hook 18.

Figure 4:
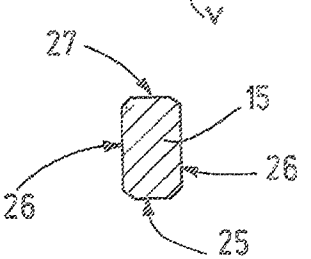
FIG. 4 shows a cross-section through the shank of the machine knitting needle according to the line of section IV-IV in FIG. 3.

Apart from the bearing gap, the shank 15 of the machine knitting needle 12 is preferably embodied without cavities or apertures, in particular slots or holes. In FIG. 4 the shank 15 is shown in its cross-section along the line of section IV-IV in FIG. 3 and in accordance with the example has a substantially rectangular cross-section with chamfered corner regions. The cross-section could also have an oval, round or other shape.

The rear end 17 is directly adjoined by a drive portion A of the machine knitting needle 12. In the exemplary embodiment the stitch-forming portion M is connected to the drive portion A by means of an intermediate portion Z. The intermediate portion Z in accordance with the example directly adjoins the stitch-forming portion M on the one hand and directly adjoins the drive portion A on the other hand.

In the drive portion A, the machine knitting needle 12 has a butt part 24, which is designed to cooperate with a cam of a knitting machine and in particular a circular knitting machine. By means of the butt part 24, the machine knitting needle 12 can be moved or positioned in the longitudinal direction L. In the case of a circular knitting machine, a knitting cylinder is for this purpose driven in rotation about a rotation axis extending parallel to the longitudinal direction L. Here, the butt part 24 protrudes into a track of the cam of the knitting machine and positions or moves the machine knitting needle 12 depending on the course of the track in the longitudinal direction L.

The shank 15, outside the stitch-forming portion M, has different heights in a height direction H, which is oriented at right angles to the longitudinal direction L and at right angles to the transverse direction Q. The height of the shank 15 or of the parts thereof is specified in each case relative to a plane E in which an underside 25 of the shank 15 extends. Outside the stitch-forming portion M, the underside 25 runs within the plane E at each point of the shank 15 and does not have any elevations or indentations relative to this plane E. Merely directly adjacently to the rear end 17 can the underside 25 transition by a radius or a chamfer into a rear edge at the rear end 17. This radius or this chamfer does not belong to the underside 25, which extends completely within the plane E.

The underside 25 is adjoined by two side faces 26 of the shank 15, which are arranged at a distance from one another in the transverse direction Q. In the exemplary embodiment the two side faces 26 each extend in their own plane, wherein these planes are oriented parallel to one another and are spanned by the longitudinal direction L and the height direction H. Opposite the underside 25, the shank 15 has an upper side 27. The upper side 27 and the underside 25 are connected to one another by the two side faces 26.

The side faces 26 are formed outside the stitch-forming portion M without indentations or apertures, and instead constitute continuous, closed faces. Outside the stitch-forming portion M, the shank 15 has elevations and indentations as necessary, which are open on the upper side 27.

Within the drive portion A, the shank 15 forms at least one rib portion, and in accordance with the example a plurality of rib portions 30 arranged at a distance from one another in the longitudinal direction L. Each rib portion 30 has a rib height h1 of at most 1.1 mm in the height direction H. In the exemplary embodiment each machine knitting needle 12 has three rib portions 30. In the drive portion A, the shank 15 has its shortest height at each of the rib portions 30 with the rib height h1. The rib portions 30 in the exemplary embodiment all have the same rib height h1. It would also be possible for two or more rib portions 30 to each have different rib heights.

The respective rib length v in length direction L of one or several or all present rib portions is at least as great as a length dimension y of the butt part 24 in length direction L and can for example be at least 1 time to 1.5 times as great as the length dimension y of the butt part 24.

The butt part 20 in the height direction H has a butt part height h2, which is much greater than the rib height h1. At the butt part 24, the shank 15 or the machine knitting needle 12 has its greatest height, so that the butt part height h2 represents the maximum height of the shank 15.

In the drive portion A, the shank 15 additionally has at least one support elevation 31. In the exemplary embodiment every two support elevations 31 form a common pair 32. The support elevations 31 are arranged at a distance from the butt part 24 in the longitudinal direction L. In accordance with example at least one rib portion 30 is disposed between the butt part 24 and the at least one support elevation 31.

Figure 6:
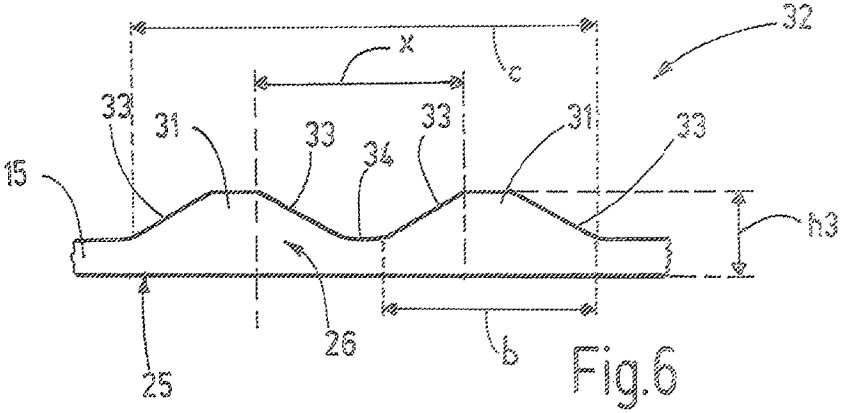
FIG. 6 shows a partial view of the drive portion of the machine knitting needle from FIG. 2 with a pair of two support elevations.

In the exemplary embodiment described here, the machine knitting needles 12 each have at least two groups 32 and therefore a total of at least four support elevations 31. Each support elevation 31 has a hump-like design and a point of maximum height that has an elevation height h3 (FIG. 6). Starting from the region or the point of maximum height (elevation height h3), each support elevation 31 has a flank 33 on both opposite longitudinal sides, said flanks extending at an incline to the height direction H and at an incline to the longitudinal direction L. The two support elevations 31 within the same group 32 delimit therebetween a furrow 34 in the longitudinal direction, which furrow is connected to one flank 33 of each of the support elevations 31. The two support elevations 31 have, in the longitudinal direction L, between their maxima at which they have the elevation height h3, a support distance x, which represents the minimum distance in the longitudinal direction L between the maxima of the two support elevations 31. The height of the shank in a furrow 34 is preferably at least as great as, and in accordance with the example greater than, the height in the rib portions 30.

Figure 2:
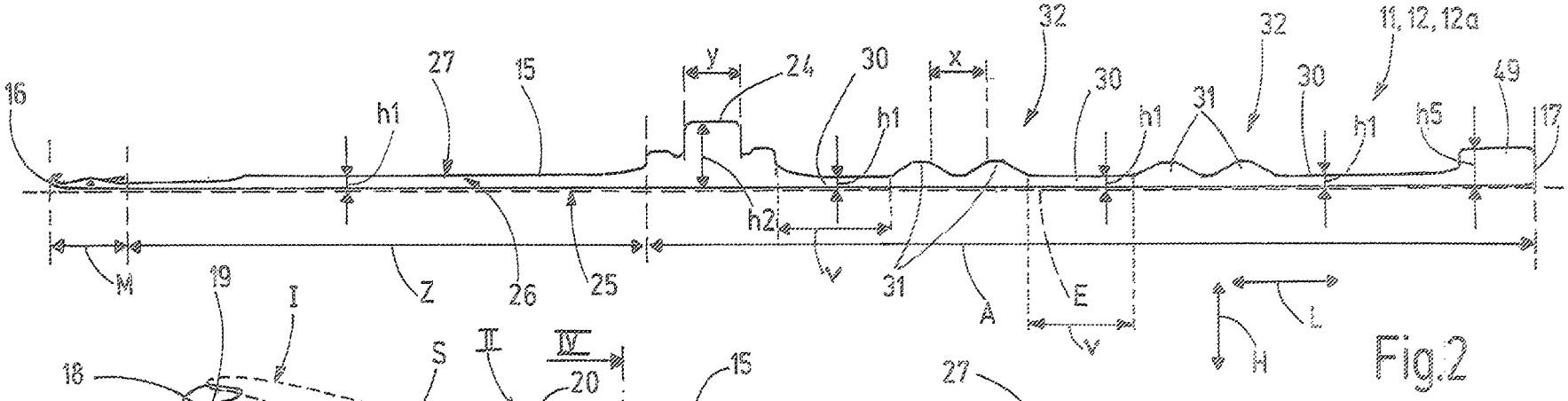
FIG. 2 shows a side view of an exemplary embodiment of a machine knitting needle.
Figure 3:
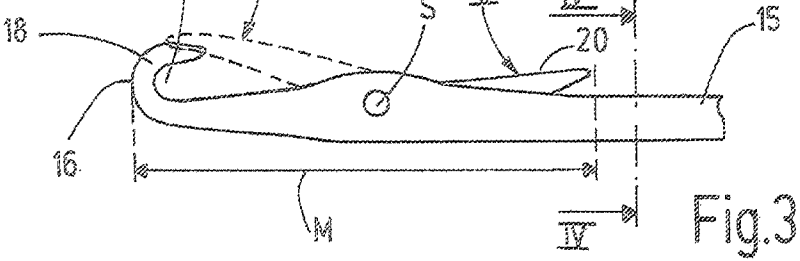
FIG. 3 shows a stitch-forming portion of the machine knitting needle from FIG. 2.

In the exemplary embodiment the support distance x is at least as great as a length dimension y of the butt part 24 in the longitudinal direction L (FIGS. 2 and 7).

Each support elevation 31 has an elevation basis length b between the transition points of the flanks 33 with an adjacent section of the needle shank 15 (FIG. 6). The elevation basis length b of a single support elevation 31 is preferably at least as great as the length dimension y of the butt part 24 and at most 1.5 to 2 times as great as the length dimension y of the butt part, such that it particularly applies: $y \le b \le 1.5 \cdot y$ or $y \le b \le 2 \cdot y$.

A group of two support elevations 31 has a group basis length c between the transition points of the two outer most flanks 33 with an adjacent section of the needle shaft 15 (FIG. 6). The group basis length c is preferably at least two times as great as the length dimension y of the butt part 24 and at most three to four times as great as the length dimension y of the butt part 24, such that it particularly applies: $2 \cdot y \le c \le 3 \cdot y$ or $2 \cdot y \le c \le 4 \cdot y$ In the exemplary embodiment described here, the two elevations 31 of a pair 32 can be formed identically. Each machine knitting needle 12 preferably has at least one group 32 with two identical support elevations 31. The two elevations 31 of a group 32 can also be formed differently from one another.

Figure 5:
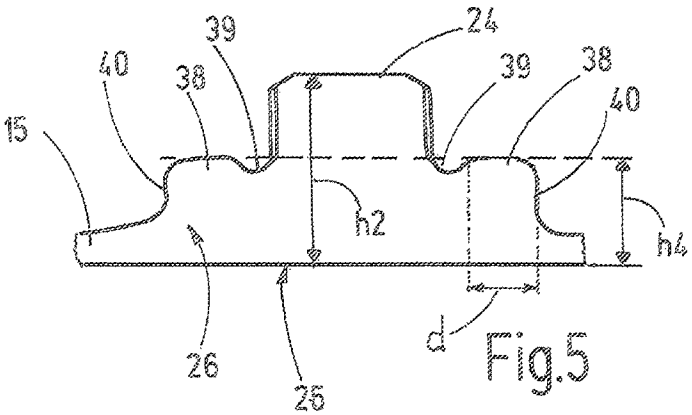
FIG. 5 shows a partial view of a drive portion of the machine knitting needle from FIG. 2 with a butt part of the machine knitting needle.

In the drive portion A, the butt part 24 in the exemplary embodiment is arranged between two support parts 38, which in the height direction H each have a support part height h4 (FIG. 5). The support part height h4 of the two support parts 38 is preferably the same. The support part height h4 is at least as great as the elevation height h3 of the support elevations 31, and in accordance with the example is greater. The support part height h4 is smaller than the butt part height h2.

The two support parts 38 each transition into the butt part 24 by a transition portion 39 on the upper side 27. The transition portion 39 has at least in part a shorter height than the support parts 38 and for example can be formed by a concave course of the upper side 27. On the sides opposite the transition portion 39, the respective support parts 38 in the exemplary embodiment have an edge 40, which runs substantially at the height direction H or relative to the height direction H encloses an acute angle and in particular a small acute angle of at most 10° to 15°. The gradient of the edge 40 relative to the longitudinal direction L is greater than the gradient of the flanks 33 of the support elevations 31.

Each support part 38 has a support part basis length d between the transition portion 39 and the edge 40 (FIG. 5). The support part basis length d is preferably at least as great as the length dimension y of the butt part 24 and at most 1.5 to two times as great as the length dimension y of the butt part 24, such that it preferably applies: $y \le d \le 1.5 \cdot y$ or $y \le d \le 2 \cdot y$.

The machine knitting needle 12 has an end part 49 directly adjacently to its rear end 17. The end part 49 has an end part height h5 which is at least as great as the elevation height h3 and in the exemplary embodiment is at least as great as the support part height h4. The end part height h5 is smaller than the butt part height h2.

In the case of some of the machine knitting needles 12, in particular in the case of the first machine knitting needle 12*a*, the second machine knitting needle 12*b*, and the third machine knitting needle 12*c*, the end part 49 has a substantially rectangular contour. In the case of the fourth machine knitting needle 12*d*, the butt part 24 is arranged close to the rear end 17, so that there the support part 38 arranged between the rear end 17 and the butt part 24 has a modified shape and, instead of its edge 40, drops down to the rear end 17 by means of a chamfer 50 (FIGS. 1 and 7). The end part 49 of this fourth machine knitting needle 12*d* thus differs from that of the other machine knitting needles 12*a*, 12*b*, 12*c*.

As can be seen in particular in FIGS. 1 and 7, the distance of the butt part 24 from the front end 16 and from the rear end 17 in the case of each machine knitting needle 12*a*, 12*b*, 12*c*, 12*d* within the same group 10 is different, so that each of these machine knitting needles 12*a*, 12*b*, 12*c*, 12*d* has a different butt position. In the region of the shank at which the butt part 24 of another machine knitting needle within this group 10 is located, the machine knitting needle has the at least one support elevation 31 or the pair 32 formed of two support elevations 31. In FIG. 7 it is shown, on the basis of the dashed lines, that, for example at the butt position of the butt part 24 of the second machine knitting needle 12*b*, each of the other machine knitting needles 12*a*, 12*c* and 12*d* within this group 10 comprises a pair 32, comprising in each case two support elevations 31. The machine knitting needles 12*a*, 12*c* and 12*d* can be supported in the guide channel when the butt part 24 during operation of a circular knitting machine is inclined or tilted about an axis parallel to the longitudinal direction L, since a force acts in the transverse direction Q on the butt part 24 during operation. As a result of the support, damage to the butt part 24 and the knitting machine is avoided, or this risk is reduced.

All machine knitting needles 12*a*, 12*b*, 12*c* and 12*d* within a group 10 have the same overall length between the front end 16 and the rear end 17 in the longitudinal direction L.

The described machine knitting needle 12 is suitable in particular for the knitting of staple fibre yarns, for example cotton yarns. It is insensitive to contamination, in particular remaining cotton or yarn, which passes into the guide channel of the knitting machine during the knitting process. In addition, the machine knitting needle 12 is designed to absorb jerky accelerations introduced via the butt part 24 and has a long service life.

The invention relates to a machine knitting tool 11 and in particular a machine knitting needle 12 having a shank 15 extending in the longitudinal direction L. The machine knitting tool 11 has a stitch-forming portion M directly adjacently to a front end 16 and a drive portion A directly adjacently to a rear end 17. At least in the drive portion A, an underside 25 of the shank 15 does not have any indentations or recesses and extends along a plane E. The shank 15 in the drive portion A forms at least one rib portion 30 with a rib height h1, which is at most 1.1 mm. In addition, the shank 15 in the drive portion A forms at least one support elevation 31, which extends in the height direction H beyond the rib height h1 of the at least one rib portion 30 and has an elevation height h3 at its point of maximum height.

LIST OF REFERENCE SIGNS

10 group
11 machine knitting tool
12 machine knitting needle
12*a* first machine knitting needle
12*b* second machine knitting needle
12*c* third machine knitting needle
12*d* fourth machine knitting needle
15 shank
16 front end
17 rear end
18 needle hook
19 hook interior
20 latch
24 butt part
25 underside
26 side face
27 upper side
30 rib portion
31 support elevation
32 pair
33 flank
34 furrow
38 support part
30 transition portion
40 edge
49 end part
50 chamfer
I closed position
II open position
A drive portion
b elevation basis length
c group basis length
d support part basis length
E plane
H height direction
h1 rib height
h2 butt part height
h3 elevation height
h4 support part height
h5 end part height
L longitudinal direction
M stitch-forming portion
Q transverse direction
S pivot axis
v rib length
x support distance
y length dimension of the butt part
Z intermediate portion

The invention claimed is:

1. A machine knitting tool, comprising:

a shank extending in a longitudinal direction between a front end and a rear end opposite the front end, the shank having an underside extending from the front end to the rear end, an upper side opposite the underside, and two side faces arranged at a distance in a transverse direction and connecting the underside and the upper side, a stitch-forming portion extending from the front end to an intermediate portion, a drive portion extending from the intermediate portion to the rear end, the drive portion including a butt part that extends with a butt part height in a height direction at right angles to the longitudinal direction and the transverse direction and is configured to cooperate with a cam of a knitting machine, wherein the entire underside of the shank in at least the drive portion extends in a plane and is free from indentations such that the entire underside of at least the drive portion is configured to bear against a surface of the knitting machine, wherein the shank in the drive portion forms at least one rib portion with a rib height of at most 1.1 mm measured from the planar underside of the drive portion, and at least one support elevation extends in the height direction in the drive portion and is arranged at a distance from the butt part in the longitudinal direction and has an elevation height that is greater than the rib height and smaller than the butt part height.

2. The machine knitting tool according to claim 1, wherein the drive portion comprises at least one pair of two support elevations including the at least one support elevation.

3. The machine knitting tool according to claim 2, wherein the two support elevations of a same pair of the at least one pair are arranged at a support distance from one another in the longitudinal direction.

4. The machine knitting tool according to claim 3, wherein the support distance is a shortest distance in the longitudinal direction between maxima of the two support elevations.

5. The machine knitting tool according to claim 3, wherein the support distance corresponds to a length dimension of the butt part in the longitudinal direction.

6. The machine knitting tool according to claim 1, wherein the rear end is arranged at an end part of the shank with a substantially rectangular contour.

7. The machine knitting tool according to claim 6, wherein an end part height of the end part is at least as great in the height direction as the elevation height.

8. The machine knitting tool according to claim 1, wherein individual ones of the at least one support elevation have two flanks running at an incline to the height direction and at an incline to the longitudinal direction.

9. The machine knitting tool according to claim 1, wherein individual ones of the at least one rib portion are arranged between the at least one support elevation and the butt part.

10. The machine knitting tool according to claim 1, wherein the at least one rib portion is a plurality of rib portions, wherein individual ones of the plurality of rib portions each have a same rib height relative to one another.

11. The machine knitting tool according to claim 1, wherein the butt part is arranged between two support parts, which each extend in the height direction by a support part height that is at least as great as the elevation height.

12. A group formed of a plurality of machine knitting tools according to claim 1, wherein the butt part of each of the plurality of machine knitting tools within the group has a different butt position at a different distance from the front and/or the rear end compared to the other or each of the others of the plurality of machine knitting tools within the group, and wherein each of the plurality of machine knitting tools within the group has the at least one support elevation at a position in the longitudinal direction lying in a region of the butt position of another of the plurality of machine knitting tools within the group.

* * * * *